US008523345B2

(12) United States Patent
Suzuki et al.

(10) Patent No.: US 8,523,345 B2
(45) Date of Patent: Sep. 3, 2013

(54) RECORDING APPARATUS

(75) Inventors: Yoshiaki Suzuki, Nagareyama (JP); Yuji Kanome, Yokohama (JP); Seiji Suzuki, Ebina (JP); Hiroyuki Tanaka, Kawasaki (JP); Takeaki Nakano, Inagi (JP); Masahiro Sugimoto, Yokohama (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 382 days.

(21) Appl. No.: 12/902,939

(22) Filed: Oct. 12, 2010

(65) Prior Publication Data

US 2011/0115863 A1 May 19, 2011

(30) Foreign Application Priority Data

Nov. 17, 2009 (JP) ..... 2009-262071

(51) Int. Cl.

| | |
|---|---|
| ***B41J 2/01*** | (2006.01) |
| ***B41J 2/015*** | (2006.01) |
| ***B41J 2/185*** | (2006.01) |
| ***B41J 29/13*** | (2006.01) |

(52) U.S. Cl.
USPC ..... 347/102; 349/21; 349/90; 349/108

(58) Field of Classification Search
None
See application file for complete search history.

(56) References Cited

U.S. PATENT DOCUMENTS

| | | | | |
|---|---|---|---|---|
| 4,223,324 | A * | 9/1980 | Yamamori et al. | 347/21 |
| 5,212,008 | A * | 5/1993 | Malhotra et al. | 428/216 |
| 6,390,593 | B1 * | 5/2002 | DeRoos et al. | 347/31 |
| 6,457,803 | B1 * | 10/2002 | Ohkoda | 347/36 |
| 6,536,863 | B1 | 3/2003 | Beauchamp | |
| 7,334,883 | B2 | 2/2008 | Campillo | |
| 2005/0253912 | A1 * | 11/2005 | Smith et al. | 347/102 |
| 2008/0094459 | A1 | 4/2008 | Sakagami | |
| 2008/0156070 | A1 * | 7/2008 | Kojima et al. | 73/23.2 |
| 2008/0252687 | A1 * | 10/2008 | Silverbrook | 347/42 |
| 2009/0109257 | A1 * | 4/2009 | Shimazaki | 347/31 |

FOREIGN PATENT DOCUMENTS

| | | | |
|---|---|---|---|
| CN | 101032887 | A | 9/2007 |
| EP | 1958783 | A1 | 8/2008 |
| JP | 2006-044021 | A | 2/2006 |
| JP | 2009-262543 | A | 11/2009 |

* cited by examiner

*Primary Examiner* — Stephen Meier
*Assistant Examiner* — Alexander C Witkowski
(74) *Attorney, Agent, or Firm* — Canon U.S.A., Inc. IP Division

(57) ABSTRACT

An apparatus includes a humidifying unit that generates humidified gas, a drying unit that dries ink applied to a sheet by a recording unit, a first duct that supplies gas discharged from the drying unit to at least one of the humidifying unit and the recording unit, and a second duct that supplies the humidified gas generated by the humidifying unit to the recording unit.

17 Claims, 7 Drawing Sheets

RECORDING APPARATUS

BACKGROUND OF THE INVENTION

1. Field of the Invention

The present invention relates to an inkjet recording apparatus.

2. Description of the Related Art

A line-type inkjet recording apparatus includes a line-type recording head in which a nozzle row is formed over the entire recording area. In the nozzle row, volatile components in ink contained in nozzles that are not frequently used evaporate and viscosity of the ink increases accordingly. When the viscosity of the ink increases, there is a risk that ink ejection failure will occur in the nozzles.

To prevent this, a system has been proposed in which humidified gas (air) is supplied to an area around the nozzles of the recording head to suppress evaporation of the volatile components in the ink. For example, Japanese Patent Laid-Open No. 2006-44021 discusses a recording apparatus including a humidifying unit that supplies the humidified gas to a gap between the recording head and a sheet.

A large amount of energy is used to generate the humidified gas. A large amount of energy loss occurs if the humidified gas supplied to the area around the nozzles is directly discharged to the outside of the apparatus. Therefore, according to an embodiment illustrated in FIG. 9 of Japanese Patent Laid-Open No. 2006-44021, a circulation system is provided in which the humidified gas that has passed by the nozzles is guided to the humidifying unit again by a duct and is reused.

However, this is a local circulation system that involves only the humidifying unit. Therefore, the energy efficiency of the entire system of the recording apparatus can be further increased.

SUMMARY OF THE INVENTION

An apparatus according to an aspect of the present invention includes a recording unit that performs a recording operation by applying ink to a sheet using a recording head; a humidifying unit that generates humidified gas; a drying unit that dries the ink applied to the sheet; a first duct that supplies gas discharged from the drying unit to at least one of the humidifying unit and the recording unit; and a second duct that supplies the generated humidified gas to the recording unit.

Further features of the present invention will become apparent from the following description of exemplary embodiments with reference to the attached drawings.

DESCRIPTION OF THE EMBODIMENTS

Figure 1:
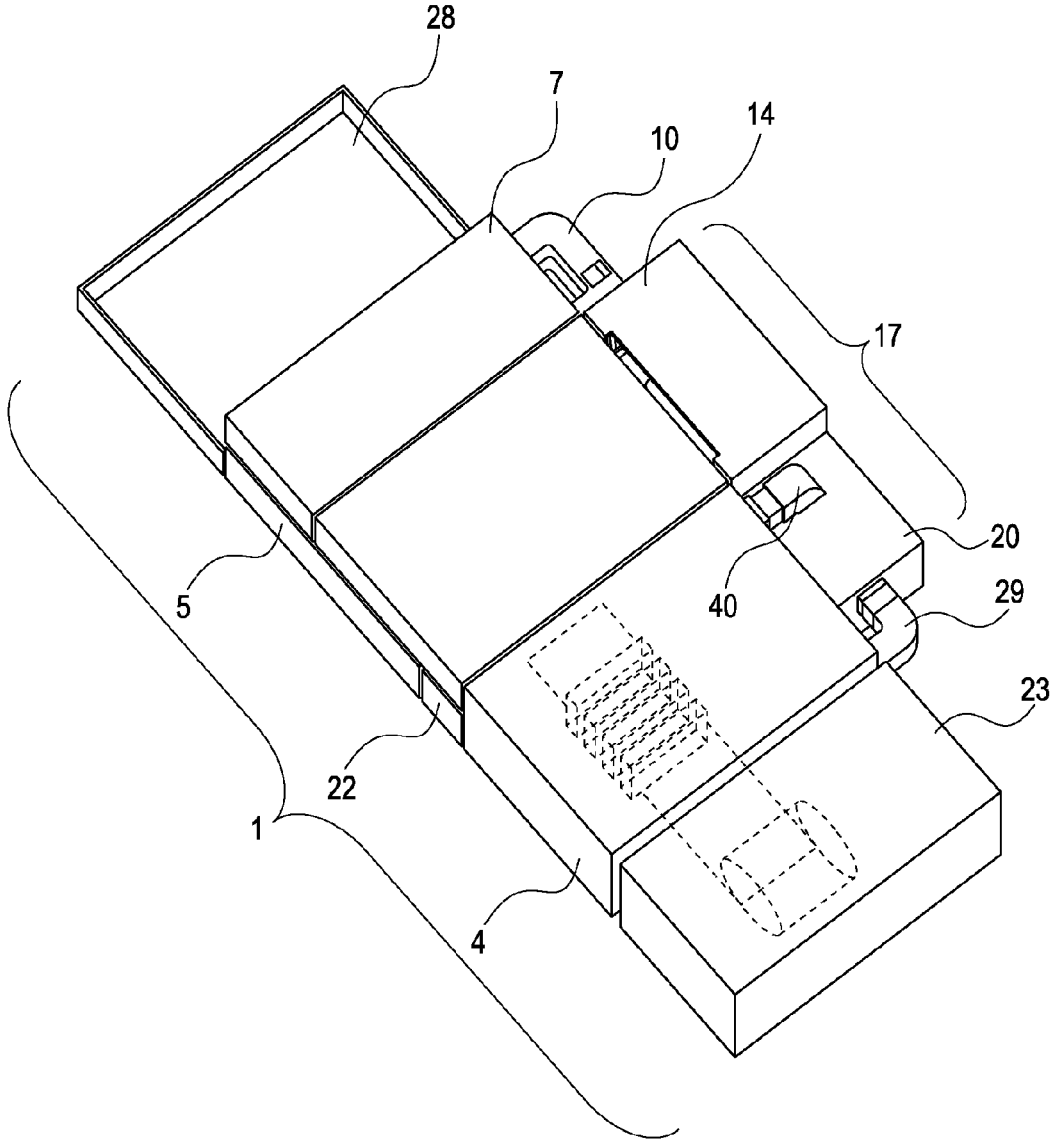
FIG. 1 is a perspective view illustrating the overall structure of a recording apparatus according to a first embodiment of the present invention.

FIG. 1 is a perspective view illustrating the overall structure of a recording apparatus 1 according to a first embodiment of the present invention. The recording apparatus 1 includes a sheet feeding unit 23, a recording unit 4, a cutter unit 22, a drying unit 5, an ink tank unit 26, a control unit 7, and a sheet ejecting unit 8, which are arranged from an upstream side to a downstream side along a conveying direction in which a sheet is conveyed in a recording operation. In addition, a humidifying unit 17 including a mixing chamber 14 and a buffer unit 20 is disposed adjacent to the recording unit 4 and the drying unit 5. Three ducts 10, 29, and 40 are connected to the humidifying unit 17.

Figure 2:
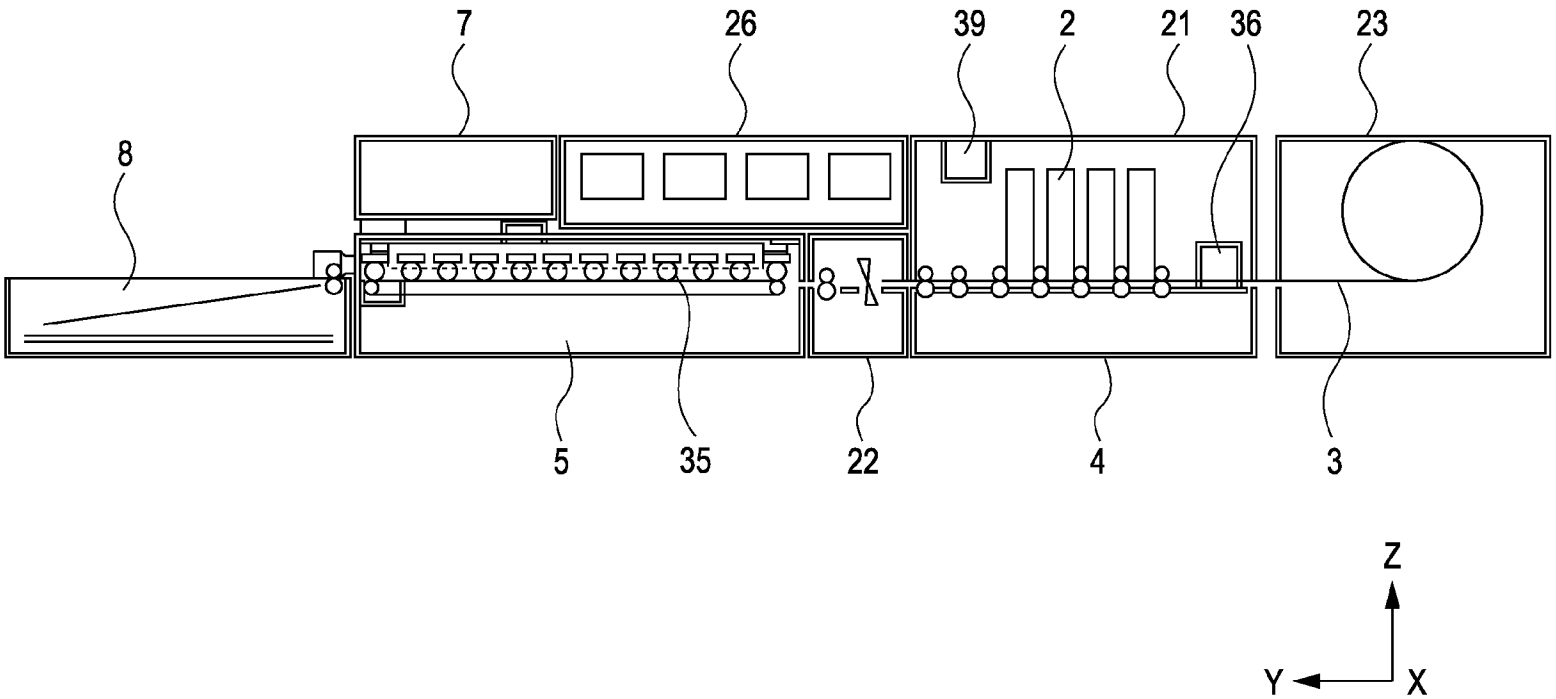
FIG. 2 is a sectional view illustrating the inner structure of the recording apparatus.

FIG. 2 is a sectional view illustrating the inner structure of the recording apparatus 1 illustrated in FIG. 1. A rolled sheet 3 is rotatably retained in the sheet feeding unit 23. In this example, the sheet 3, which is a recording medium, is a continuous sheet. However, the sheet 3 may instead be a cut sheet. The sheet feeding unit 23 includes a feeding mechanism that pulls out the sheet 3 and conveys the sheet 3 downstream in the sheet conveying direction (hereinafter referred to as a Y direction or a first direction).

The recording unit 4 includes a plurality of recording heads 2 that correspond to inks of different colors. In this example, four recording heads corresponding to four colors, which are C, M, Y, and K, are provided. However, the number of colors is not limited to this. The ink of each color is supplied from the ink tank unit 26 to the corresponding recording head 2 through an ink tube. Each recording head 2 is a line-type recording head in which an inkjet nozzle row is formed so as to cover the maximum width of the sheet 3 in which the recording head 2 may be used. The nozzle row extends in a direction (hereinafter referred to as an X direction or a second direction) that crosses the first direction (perpendicular to the first direction in this example). The nozzle row may either have a structure in which units of nozzle chips are arranged in an orderly pattern, such as a staggered pattern, over the entire area in the width direction or a structure in which a single row of nozzle chips is formed over the entire area in the width direction. An inkjet method may be, for example, a method using heating elements, piezoelectric elements, electrostatic elements, or MEMS elements.

A sheet conveying path extends through the recording unit 4 and faces the recording heads 2, and a conveying mechanism for conveying the sheet along the sheet conveying path is provided in the recording unit 4. The conveying mechanism includes a plurality of conveying rollers arranged along the sheet conveying path and a platen that supports the sheet 3 in areas between the adjacent conveying rollers. The recording heads 2 and the conveying mechanism are accommodated in a substantially closed space in a housing 21.

The cutter unit 22 is a unit that cuts the continuous sheet that has been subjected to the recording operation in the recording unit 4 into predetermined sizes. The drying unit 5 is a unit for drying the ink on the cut sheet in a short time, and includes a heater 24 and a plurality of conveying rollers 35 arranged along the conveying path. The sheet ejecting unit 8 stores cut sheets ejected from the drying unit 5, and a plurality of sheets are stacked in the sheet ejecting unit 8. The control unit 7 is a controller that controls various operations in the entire system of the recording apparatus 1, and includes a CPU, a memory, and various I/O interfaces.

Figure 3:
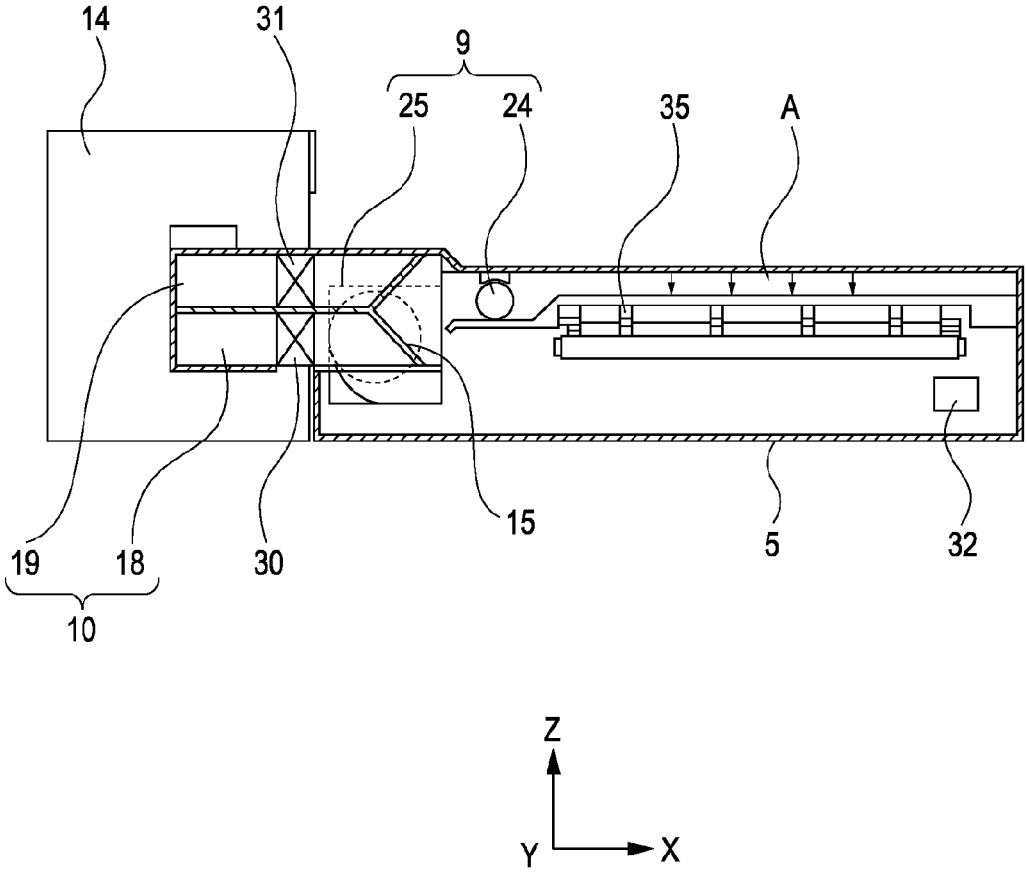
FIG. 3 is a sectional view illustrating the inner structure of a drying unit.

The detailed structure of the drying unit 5 will now be described. FIG. 3 is a sectional view illustrating the inner structure of the drying unit 5. The drying unit 5 includes a warm gas device 9 that ejects warm gas A for drying the ink ejected onto the sheet 3. The warm gas device 9 includes the heater 24 that heats gas and a fan 25 that generates a gas flow. The heated gas (warm gas) is ejected from nozzles toward a surface of the sheet 3 to which the ink has been applied. While the sheet 3 is being conveyed by the conveying rollers 35, drying of the ink on the sheet 3 is accelerated by the warm gas that has been ejected toward the sheet 3. A humidity sensor 32 is provided in the drying unit 5 as a unit for obtaining humidity information regarding humidity in the drying unit 5. The humidity sensor 32 can either directly detect the humidity or indirectly obtain the humidity information by detecting a temperature.

In the case where images for which a large amount of ink is used (images with a large recording duty), such as photographic images, are successively recorded, an amount of ink ejected from the recording heads 2 per unit time increases. Therefore, when the ink applied to the sheet is dried in the drying unit 5, the humidity in the drying unit 5 increases owing to the evaporation of a large amount of moisture. For example, when the drying unit 5 is in a high-humidity state in which the humidity is more than 20% at a set warm-gas temperature (80° C. in the present embodiment), volatile components in the ink cannot be easily evaporated even when the warm gas is ejected toward the sheet. Therefore, the humidity of the gas in the drying unit 5 is to be reduced before the state of the drying unit 5 changes to the high-humidity state.

The duct 10, which is an exhaust duct, is connected to the drying unit 5, and high-humidity gas in the drying unit 5 is exhausted through the exhaust duct 10. As illustrated in FIGS. 3 and 4A to 4C, the exhaust duct 10 includes two ducts, which are a first duct 18 and a fourth duct 19, one of which is selected as an exhaust destination in accordance with an operational state of a valve 15, which will be described below. In an ordinary state, the position of the valve 15 is set such that the gas is exhausted through the fourth duct 19.

The first duct 18 is connected to the mixing chamber 14, which will be described below. A filter 30 is disposed in the first duct 18 at an intermediate position thereof. The fourth duct 19 is connected to the drying unit 5 such that the gas discharged therethrough can be re-introduced into the drying unit 5. A filter 31 is disposed in the first duct 18 at an intermediate position thereof. In addition, a small hole 27 is provided in the fourth duct 19 at an intermediate position thereof. While the exhaust gas passes through the fourth duct 19, a part of the exhaust gas is replaced by outside gas (gas in the inner space of the recording apparatus 1), which is less humid than the gas in the fourth duct 19, through the hole 27. In other words, the high-humidity exhaust gas returns to the drying unit 5 after a part of the high-humidity exhaust gas is dissipated into the inner space of the recording apparatus 1. Therefore, the humidity in the drying unit 5 can be somewhat reduced.

Figure 4A:
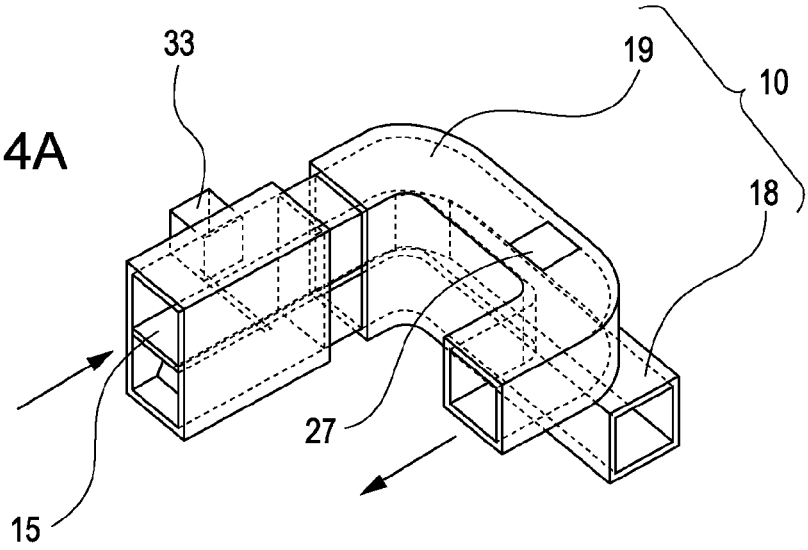
FIGS. 4A, 4B, and 4C are diagrams illustrating the operation of an exhaust duct.
Figure 4B:
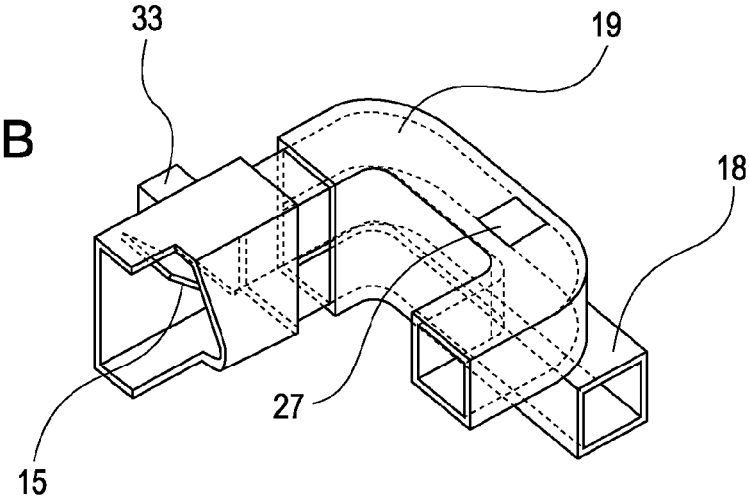
Figure 4C:
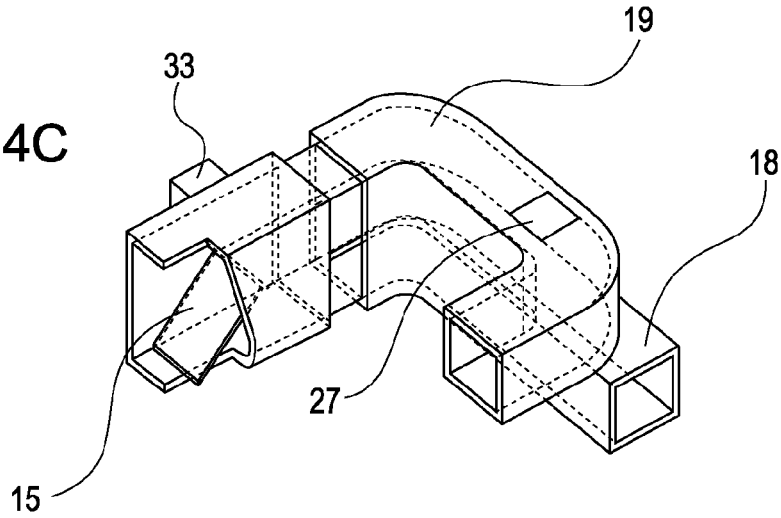

FIG. 4A illustrates the state in which neither of the first duct 18 and the fourth duct 19 is blocked by the valve 15. FIG. 4B illustrates the state in which the valve 15 blocks the fourth duct 19 to select the first duct 18. FIG. 4C illustrates the state in which the valve 15 blocks the first duct 18 to select the fourth duct 19. The valve 15 is a mechanism for controlling the flow of the gas that is exhausted from the drying unit 5. The valve 15 controls an operation of supplying the gas from the drying unit 5 to the recording unit 4. The valve 15 can be rotated about a support shaft by a switching mechanism 33 including a motor and a gear. The rotation of the valve 15 is controlled by the control unit 7. One of the states illustrated in FIGS. 4B and 4C is selected. The state of the valve 15 is determined by a sensor 34 (photo interrupter or the like) that detects a rotational phase of the switching mechanism 33. Thus, the first duct 18 and the fourth duct 19 included in the exhaust duct 10 are arranged adjacent to each other, and one of the first and fourth ducts 18 and 19 is selected as a path through which the gas is to be exhausted in accordance with the rotation of a single valve 15. Therefore, the switching operation can be quickly performed by a simple structure.

Figure 5:
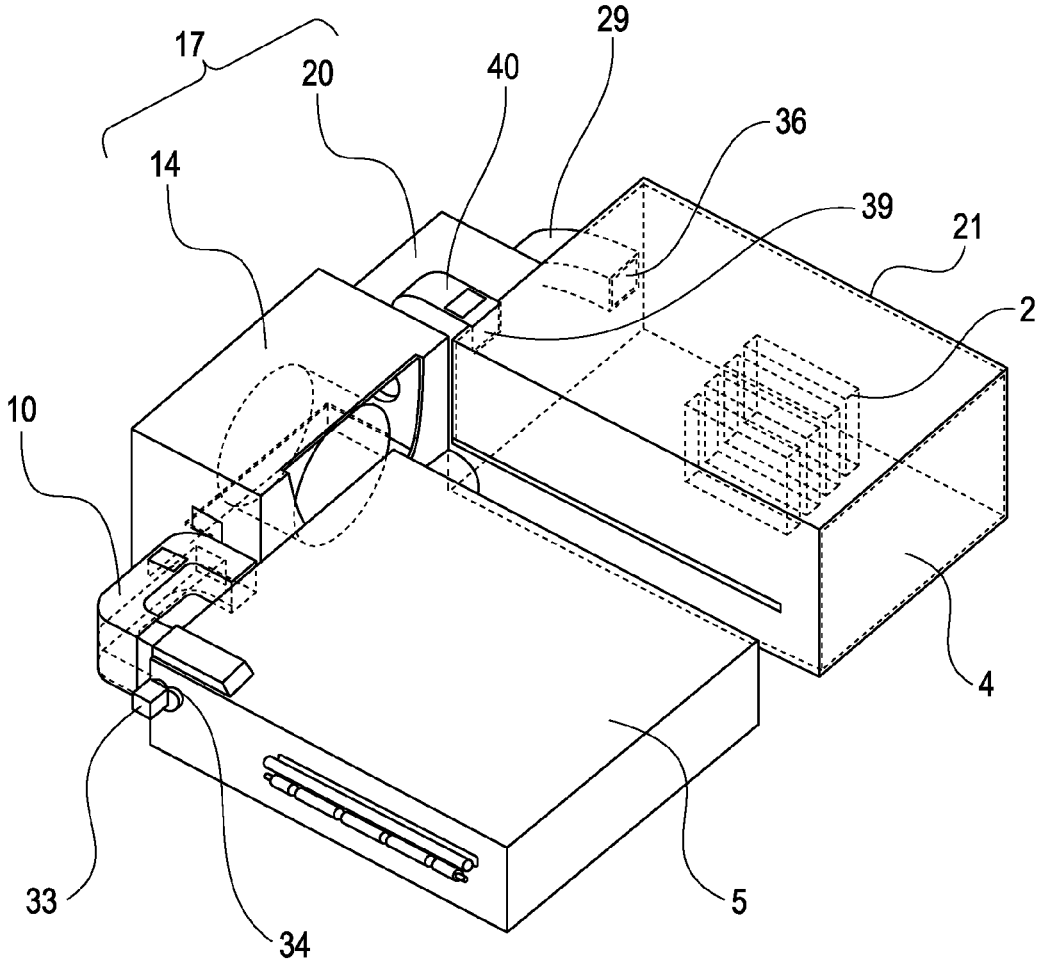
FIG. 5 is a diagram illustrating the manner in which a recording unit, the drying unit, and a humidifying unit are connected to each other.

FIG. 5 is a diagram illustrating the manner in which the recording unit 4, the drying unit 5, and the humidifying unit 17 are connected to each other with the ducts. The humidifying unit 17 generates humidified gas (humidified air) and supplies the humidified gas to an area around the nozzle rows in the recording heads 2. End portions of the nozzles are humidified by the humidified gas that flows by the nozzles, and accordingly the evaporation and drying of the ink in the nozzles can be reduced. Therefore, even if the time in which the nozzles have not been used is long, ejection failure due to sticking of the ink in the nozzles can be prevented.

The humidifying unit 17 includes the mixing chamber 14 that generates the humidified gas and the buffer unit 20 that accumulates the generated humidified gas while maintaining the temperature and humidity thereof at predetermined temperature and humidity. The buffer unit 20 and the recording unit 4 are connected to each other by the second duct 29. The second duct 29 is connected to the buffer unit 20 at one end thereof, and to an opening 36, which is an inlet formed in a side surface of the housing 21 of the recording unit 4, at the other end thereof. The humidified gas supplied from the humidifying unit 17 flows through the second duct 29 and is introduced into the housing 21 through the opening 36. The opening 36 formed in the housing 21 is positioned such that the humidified gas flows into a gap between the sheet and one of the recording heads 2 that is at the most upstream position in the sheet conveying direction (see FIG. 2). Accordingly, the humidified gas introduced into the housing 21 can smoothly flow through the gap between the sheet surface and the recording heads 2 from an upstream position to a downstream position along the direction in which the sheet is conveyed. An opening 39, which is an outlet, is also provided in the recording unit 4, and one end of the third duct 40 is connected to the opening 39. The other end of the third duct 40 is connected to the mixing chamber 14. The opening 39 is formed in the housing 21, and is positioned downstream of one of the recording heads 2 that is at the most downstream position in the sheet conveying direction (see FIG. 2). Accordingly, the humidified gas that has flowed through the gap between the sheet surface and the recording heads 2 from the upstream position to the downstream position can be smoothly discharged from the housing 21. The humidified gas introduced into the recording unit 4 through the second duct 29 is discharged through the third duct 40 and is re-introduced into the mixing chamber 14 as reflow gas for reuse (recycle). In other words, the gas discharged from the recording unit 4 is re-introduced into the humidifying unit 17 through the third duct 40.

Figure 6:
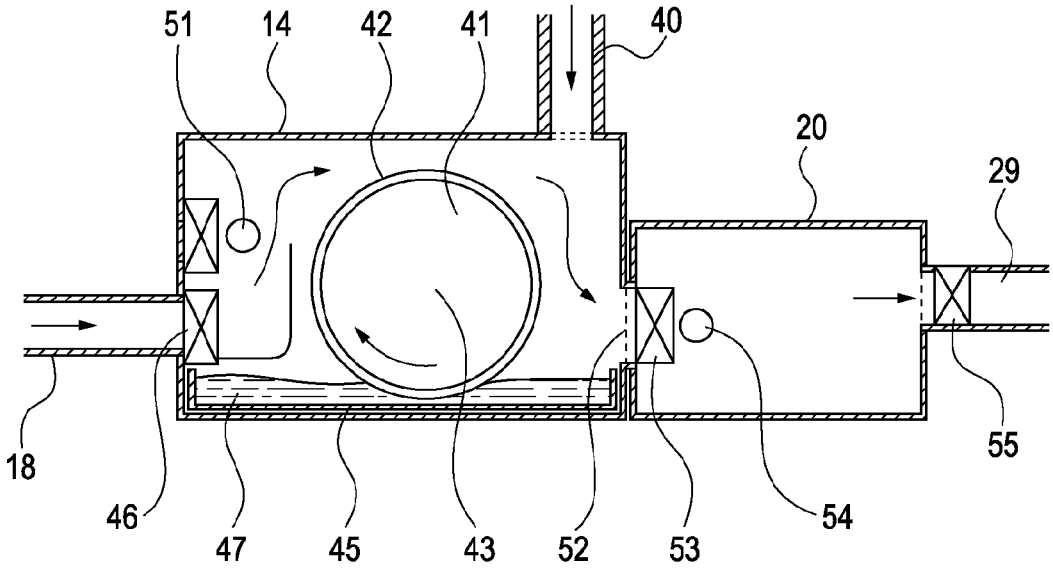
FIG. 6 is a sectional view illustrating the inner structure of the humidifying unit.

FIG. 6 is a sectional view illustrating the inner structure of the humidifying unit 17. The humidifying unit 17 includes the mixing chamber 14 and the buffer unit 20. The mixing chamber 14 generates the humidified gas by a vaporizing method. The mixing chamber 14 includes a disc 41 on which a liquid absorbing member 42 is bonded. The disc 41 can be rotated about a shaft 43 by a driving mechanism. Alternatively, the disc 41 itself may be formed of a material having a high liquid absorbability. A part of the disc 41 is in contact with water 47 that is stored in a lower section of a water tank 45. The disc 41 rotates to cause the entire body of the liquid absorbing member 42 to absorb water. A fan 46 causes the gas supplied from the drying unit 5 through the first duct 18 to generate a gas flow in the mixing chamber 14. The gas to be reused is also introduced into the mixing chamber 14 through the third duct 40, and is mixed into the gas flow in the mixing chamber 14. The gas flow generated by the fan 46 is heated by a heater 51, and passes the liquid absorbing member 42 of the disc 41, which is being rotated, while hitting the liquid absorbing member 42. At this time, a part of the moisture carried by the liquid absorbing member 42 is mixed into the gas. Thus, the humidified gas is generated. The humidifying performance of the mixing chamber 14 can be adjusted in accordance with the rotational speed of the disc 41, the rotational speed of the fan 46, and the amount of heat generated by the heater 51. The humidifying performance is feedback-controlled by the control unit 7 on the basis of the result of detection of a humidity sensor (not shown) so that the humidified gas at an appropriate humidity can be generated. The structure of the humidifying unit 17 is not limited to that in the present embodiment. For example, various known methods, such as a vaporizing method, a water atomizing method, and a steam method, may be used. The vaporizing method includes a moisture permeable film method, a dripping seepage method, and a capillary method in addition to the rotating method used in the present embodiment. The water atomizing method includes a supersonic method, a centrifugal method, a high-pressure spray method, and a two-fluid atomizing method. The steam method includes a steam line method, an electrothermal method, and an electrode method.

The buffer unit 20 is a chamber that stores the humidified gas generated in the mixing chamber 14 while maintaining the temperature and humidity thereof at predetermined temperature and humidity. The humidified gas generated in the mixing chamber 14 is introduced into the buffer unit 20 through a supply duct 52 and a fan 53. The humidified gas supplied to the buffer unit 20 is heated by a heater 54 and is stored while the temperature and humidity thereof are maintained constant. The humidified gas stored in the buffer unit 20 is discharged through the second duct 29 by a fan 55.

Figure 7A:
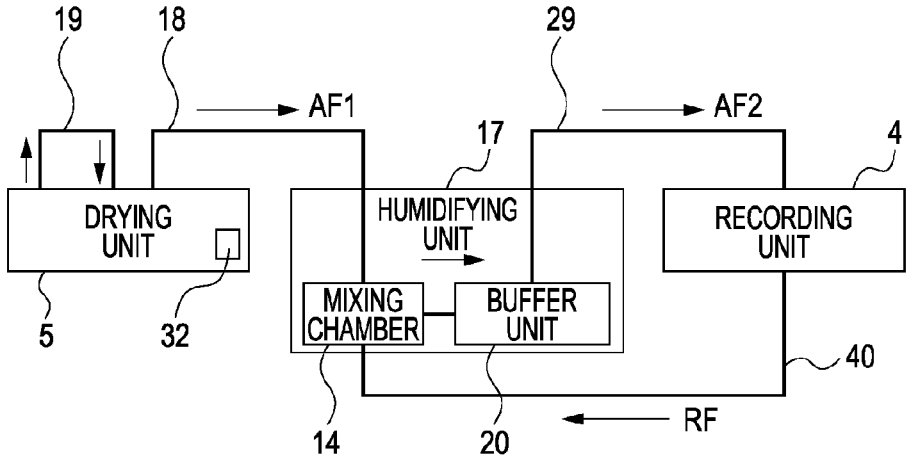
FIGS. 7A, 7B, and 7C are block diagrams illustrating the concept of a gas circulation system according to respective embodiments.

FIG. 7A is a block diagram illustrating the concept of a gas circulation system in the recording apparatus 1 according to the present embodiment. The drying unit 5 and the mixing chamber 14 in the humidifying unit 17 are connected to each other by the first duct 18. An exhaust port and an inlet port of the fourth duct 19 are both connected to the drying unit 5. One of the first duct 18 and the fourth duct 19 is selected as the exhaust destination by the above-described valve 15. The humidified gas generated in the mixing chamber 14 is introduced into the buffer unit 20. The buffer unit 20 and the recording unit 4 are connected to each other by the second duct 29. The recording unit 4 and the mixing chamber 14 are connected to each other by the third duct 40.

In an ordinary state, the fourth duct 19 is selected by the valve 15. The humidity information of the drying unit 5 is obtained by the humidity sensor 32. If it is determined from the humidity information that the humidity is higher than a predetermined value, the valve 15 switches to the first duct 18. The high-humidity gas generated in the drying unit 5 is introduced into the mixing chamber 14 through the first duct 18 as a gas flow AF1 and is mixed with the gas in the mixing chamber 14, thereby assisting the generation of the humidified gas in the humidifying unit 17. A gas flow AF2 from the buffer unit 20 is introduced into the recording unit 4 through the second duct 29. The humidified gas in the recording unit 4 is introduced into the mixing chamber 14 through the third duct 40 as a gas flow RF and is mixed with the gas in the mixing chamber 14, thereby assisting the generation of the humidified gas in the humidifying unit 17. Thus, the moisture discharged from the drying unit 5 and the moisture discharged from the recording unit 4 are both reused for humidification. Thus, a system structure with an extremely high energy utilization efficiency that is capable of generating desired humidified gas in a short time at a low power consumption is provided. In particular, in the recording unit 4 according to the present embodiment, a large amount of humidified gas is used since a plurality of recording heads 2 having long nozzle rows are provided. Therefore, compared to the case in which the above-described system structure is not used, the power consumption can be greatly reduced. In addition, since the state in which a large amount of humidified gas is discharged into the installation environment of the recording apparatus 1 does not occur, an increase in humidity in the installation environment can be suppressed.

The position at which the humidity sensor 32 is installed is not limited to the drying unit 5, and the humidity sensor 32 may instead be installed in the first duct 18 or the fourth duct 19. Alternatively, the humidity sensor 32 may be installed in the mixing chamber 14, the buffer unit 20, the second duct 29, or the recording unit 4. More specifically, a unit for obtaining the humidity information is provided in at least one of the drying unit, the humidifying unit, the recording unit, and the ducts thereof, and the valve 15 is controlled in accordance with the obtained humidity information. Alternatively, the operation of opening or closing the valve 15 may be controlled in accordance with the recording duty in the recording unit 4.

Figure 7B:
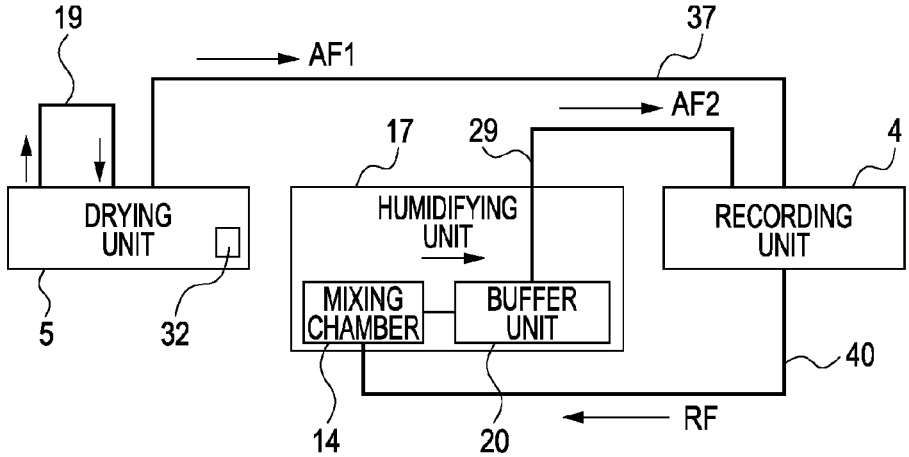

FIG. 7B is a block diagram illustrating the concept of a gas circulation system in a recording apparatus according to a second embodiment of the present invention. Components similar to those in the first embodiment are denoted by the same reference numerals, and explanations thereof are thus omitted.

In this structure, the drying unit 5 and the recording unit 4 are connected to each other by a first duct 37. Accordingly, the high-humidity gas generated in the drying unit 5 is not introduced into the humidifying unit 17, but is introduced directly into the recording unit 4 thought the first duct 37 as a gas flow AF1. One of the first duct 37 and the fourth duct 19 is selected by a valve 15 having a structure similar to that of the value shown in FIG. 4. The humidified gas generated in the humidifying unit 17 is introduced into the recording unit 4 thought the second duct 29 as a gas flow AF2. Thus, the gas exhausted from the drying unit 5 and the humidified gas generated in the humidifying unit 17 are both introduced into the recording unit 4. Therefore, the energy consumption can be reduced compared to the case in which only the humidified gas generated by the humidifying unit 17 is used. The recording unit 4 and the mixing chamber 14 are connected to each other by the third duct 40, so that the gas can be resupplied to the mixing chamber 14 as a gas flow RF. Thus, the humidified gas is reused. Accordingly, effects similar to those of the first embodiment can be obtained by the above-described structure.

Figure 7C:
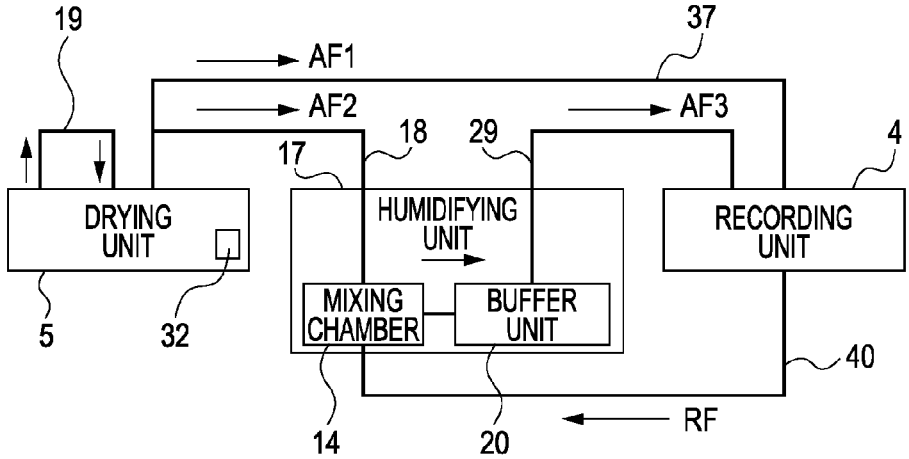

FIG. 7C is a block diagram illustrating the concept of a gas circulation system in a recording apparatus according to a third embodiment of the present invention. Components similar to those in the first embodiment are denoted by the same reference numerals, and explanations thereof are thus omitted.

The gas exhausted from the drying unit 5 is guided along two paths through a first duct 18 and a first duct 37. The first duct 18 is connected to the mixing chamber 14, and the first duct 37 is connected to the recording unit 4. Accordingly, the high-humidity gas generated in the drying unit 5 is introduced into both the humidifying unit 17 (gas flow AF2) and the recording unit 4 (gas flow AF1). One of the first duct 37 and the fourth duct 19 is selected by a valve 15 having a structure similar to that of the value shown in FIG. 4. The humidified gas generated in the humidifying unit 17 is introduced into the recording unit 4 thought the second duct 29 as a gas flow AF3. The recording unit 4 and the mixing chamber 14 are connected to each other by the third duct 40, so that the gas can be resupplied to the mixing chamber 14 as a gas flow RF. Thus, the humidified gas is reused.

The structure of FIG. 7C corresponds to the combination of the structures of FIGS. 7A and 7B. The exhaust gas from the drying unit 5 may be introduced into the recording unit 4 through the first duct 37 before the humidified gas generated by the humidifying unit 17 is supplied. In such a case, the temperature of the recording heads 2 and the housing 21 can be increased in advance. In the case where this preheating process is performed, dewing, which may occur if the humidified gas from the humidifying unit 17 immediately after the activation of the apparatus while the recording heads 2 and the housing 21 are still cool, can be prevented. If dewing occurs, there is a risk that ejection failure will occur in the recording heads 2 or water droplets will drop onto the sheet. However, such a risk can be reduced. In addition, since the heat generated in the recording apparatus is efficiently used, a starting time can be reduced in a cold environment.

In each of the structures illustrated in FIGS. 7A to 7C, the gas exhausted from the drying unit 5 is supplied to at least one of the humidifying unit 17 and the recording unit 4 through the first duct. In addition, the humidified gas generated in the humidifying unit 17 is supplied to the recording unit 4 through the second duct 29. Accordingly, the gas having a relatively high humidity that is exhausted from the drying unit 5 can be supplied to at least one of the humidifying unit 17 and the recording unit 4 and be used to assist the generation of the humidified gas. Therefore, the energy efficiency in the total system of the inkjet recording apparatus including the recording unit 4, the humidifying unit 17, and the drying unit 5 can be largely increased. In addition, the gas discharged from the recording unit 4 is supplied to the humidifying unit 17 through the third duct 40 and is reused. Therefore, the overall energy efficiency is significantly high.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-262071 filed Nov. 17, 2009, which is hereby incorporated by reference herein in its entirety.

What is claimed is:

1. An apparatus comprising:

a recording unit that performs a recording operation by applying ink to a sheet using a recording head;

a humidifying unit that generates humidified gas by a vaporizing method;

a drying unit that dries the ink applied to the sheet;

a first duct that supplies gas discharged from the drying unit into at least the humidifying unit; and a second duct that supplies the generated humidified gas to the recording unit, wherein the humidifying unit includes a chamber into which the gas discharged from the drying unit is introduced, and the humidified gas is generated in the chamber by heating the gas discharged from the drying unit with a heater and mixing the heated gas with moisture provided by a liquid absorbing member.

2. The apparatus according to claim 1, wherein the humidifying unit includes a water tank for supplying water to provide the moisture to the liquid absorbing member, and a gas flow of the introduced gas from the first duct is generated toward the heater and the liquid absorbing member by a fan.

3. The apparatus according to claim 2, wherein the humidifying unit further includes a buffer unit, the humidified gas generated in the chamber being introduced into the buffer unit, and the buffer unit is connected to the recording unit by the second duct.

4. The apparatus according to claim 1, further comprising:

a third duct that connects the recording unit to the chamber of the humidifying unit, wherein gas discharged from the recording unit is introduced into the chamber unit through the third duct and is mixed with the gas introduced through the first duct in the chamber.

5. The apparatus according to claim 4, further comprising:

a fourth duct through which the gas discharged from the drying unit is re-introduced into the drying unit and which has a hole, wherein the gas discharged from the drying unit is supplied to one of the first duct and the fourth duct.

6. The apparatus according to claim 1, further comprising:

a valve that controls a flow of the gas discharged from the drying unit, the valve controlling an operation of supplying the gas from the drying unit to at least one of the humidifying unit and the recording unit.

7. The apparatus according to claim 6, further comprising:

a unit for obtaining information regarding humidity in at least one of the drying unit, the humidifying unit, the recording unit, the first duct, and the second duct, wherein the valve is controlled in accordance with the obtained humidity information.

8. The apparatus according to claim 6, wherein the valve is controlled in accordance with a recording duty of the recording unit.

9. The apparatus according to claim 1, wherein the recording unit includes a housing that accommodates a plurality of recording heads of inkjet type, and wherein the second duct is connected to an inlet provided in the housing, the inlet being positioned such that the humidified gas flows into a space between the sheet and one of the recording heads that is at the most upstream position in a sheet conveying direction in which the sheet is conveyed.

10. The apparatus according to claim 9, further comprising:

a third duct that connects the recording unit to the humidifying unit, one end of the third duct being connected to an outlet provided in the housing, the outlet being positioned downstream of one of the recording heads that is at the most downstream position in the sheet conveying direction.

11. A method comprising:

performing a recording operation by applying ink to a sheet using a recording head by a recording unit;

generating humidified gas by a humidifying unit using a vaporizing method;

drying the ink applied to the sheet by a drying unit;

supplying gas discharged from the drying unit to at least the humidifying unit via a first duct; and supplying the generated humidified gas to the recording unit via a second duct, wherein the humidifying unit includes a chamber into which the gas discharged from the drying unit is introduced, and the humidified gas is generated in the chamber by heating the gas discharged from the drying unit with a heater and mixing the heated gas with moisture provided by a liquid absorbing member.

12. The method according to claim 11, wherein the humidifying unit includes a water tank for supplying water to provide the moisture to the liquid absorbing member, and a gas flow of the introduced gas from the first duct is generated toward the heater and the liquid absorbing member by a fan.

13. The method according to claim 12, further comprising:

introducing the generated humidified gas into a buffer unit in the humidifying unit;

and connecting the buffer unit to the recording unit using the second duct.

14. The method according to claim 11, further comprising:

connecting the recording unit to the chamber of the humidifying unit using a third duct; and introducing gas discharged from the recording into the chamber using the third duct and mixing with the gas introduced through the first duct in the chamber.

15. The method according to claim 14, further comprising:

re-introducing the gas discharged from the drying unit into the drying unit using a fourth duct; and supplying the gas discharged from the drying unit to one of the first duct and the fourth duct.

16. The method according to claim 11, further comprising connecting the second duct to an inlet provided in a housing for accommodating a plurality of recording heads of inkjet type in the recording unit, the inlet being positioned such that the humidified gas flows into a space between the sheet and one of the recording heads that is at the most upstream position in a sheet conveying direction in which the sheet is conveyed.

17. The method according to claim 16, further comprising:

connecting the recording unit to the humidifying unit using a third duct, one end of the third duct being connected to an outlet provided in the housing, the outlet being positioned downstream of one of the recording heads that is at the most downstream position in the sheet conveying direction.

* * * * *